US005850908A

United States Patent [19]

Jasek

[11] Patent Number: 5,850,908

[45] Date of Patent: Dec. 22, 1998

[54] PRESSURE SENSITIVE CAP CLOSURE AND VALVE

[76] Inventor: Sidney Joseph Jasek, 4427 Morris Dr., Pearland, Tex. 77584

[21] Appl. No.: 959,760

[22] Filed: Oct. 29, 1997

[51] Int. Cl.[6] ..... B65D 51/16; B65D 25/40

[52] U.S. Cl. ..... 220/203.23; 220/703; 220/714; 215/315; 222/496; 222/494; 222/212

[58] Field of Search ..... 215/307, 311, 215/315, 387, 388; 220/203.01, 203.04, 203.09, 203.1, 203.19, 203.21, 203.23, 203.24, 203.25, 203.28, 212, 231, 240, 361, 363, 367, 368, 373, 374, 703, 705, 710, 711, 713, 716; 222/212, 494, 495, 496, 492, 493, 513, 518

[56] References Cited

U.S. PATENT DOCUMENTS 2,207,816 7/1940 Packer ..... 222/496 X
4,785,978 11/1988 Kano et al. ..... 215/315 X
5,090,600 2/1992 Clark ..... 222/212 X
5,145,083 9/1992 Takahashi .
5,275,312 1/1994 Labruzzo ..... 222/496 X
5,366,115 11/1994 Kersten et al. ..... 222/496 X

*Primary Examiner*—Stephen K. Cronin
*Assistant Examiner*—Nathan Newhouse
*Attorney, Agent, or Firm*—Michael B. Jolly

[57] ABSTRACT

A closure cap valve apparatus for mounting on the top of a beverage container. A piston valve within the cap is biased towards closure to prevent spillage. Additionally, pressure increase within the container is directed to increase sealing force of seals positioned on the piston and thus prevents the release of pressure from the container, allowing the closure to be used for carbonated beverages. The piston is displaced from the closed position, even when the container internal pressure is increased, by the user sucking on a mouth piece.

10 Claims, 5 Drawing Sheets

PRESSURE SENSITIVE CAP CLOSURE AND VALVE

BACKGROUND OF THE INVENTION

This invention relates to a closure cap valve apparatus for mounting on a beverage container. The closure includes a piston valve within the cap which is biased towards closure to prevent spillage. Additionally, pressure increase within the container is directed to increase the sealing force of seals positioned on the piston and thus prevents the release of pressure and liquids from the container, allowing the closure to be used to maintain carbonation in carbonated beverages. Piston seal placement and piston configuration allows the container interior pressure to equalize with the ambient pressure after withdrawing fluid contents from the container via the closure valve. The piston is displaced from the closed position by the user applying a decrease in pressure on the dispensing end of the valve piston by sucking on the closure mouth piece. There are no external moving parts on the closure and the entire closure valve apparatus can be constructed from very few parts.

Numerous closure caps have been developed for mounting on beverage containers to facilitate ease of delivery of the container's contents which prevent spillage by the use of one-way valves, positive closure valves, and devices which act as a seal and closure valve. There are no prior devices which provide a closure means with no moving external parts with an internal piston valve which is normally biased towards closure and moved to an open position by reduction in pressure at the closure's opening, while also maintaining the internal pressure of the container which does not prevent the piston from being moved to the open position. Takahashi, patent number 5,145,083 discloses a cap device with a moveable valve member axially slidable within an interior of a valve, however internal container pressure causes an increase in valve member displacement force necessary to open the valve. The amount of force necessary to displace the valve member greatly exceeds the ability of a normal person. Furthermore, the Takahashi device does not allow the interior pressure of the container to equalize with the ambient pressure after liquid has been withdrawn from the container. The present invention utilizes a unique method of directing the increased internal pressure of a beverage container, created by offgassing of carbon dioxide in carbonated beverages, to provide increased sealing force of the cap valve member while not increasing the force necessary to displace the valve to an open position. In addition, the present invention also provides a valve which allows the container interior pressure to equalize after withdraw of the container contents, this prevents implosion of the container. Consequently the closure cap valve is useful for maintaining the effervescence of carbonated drink such as beer, soft drinks and tonic water, while also providing a spill proof closure for the beverage container which will open and deliver the contents of the container, whether or the container is under pressure, by the force exerted by a person sucking on the closure mouth piece.

SUMMARY OF THE INVENTION

It is accordingly an object of the present invention to provide a dispensing closure cap valve apparatus for attachment to a beverage container which functions as a container closure, spill proof dispensing device, a dispensing closure valve device which also maintains the internal pressure of the container while the valve is opened by a person applying normal sucking forces on the mouth piece of the closure.

It is also an object of the present invention to provide a dispensing closure cap valve device which is suitable for use with carbonated beverages such as sodas and beer, and which maintains the carbonation of these beverages while also providing a closure valve which is opened by the user gentle sucking on the closure mouth piece.

It is further an object of the present invention to provide a dispensing closure cap valve device which has no external moving parts and is constructed of few parts which may be molded by conventional known plastic molding techniques.

It is also an object of the present invention to provide a dispensing closure valve device which does not allow the container to implode after the container's contents have been withdrawn. Further the device provides a means for preventing the container interior pressure from falling below the ambient pressure outside the container while also providing a means for maintaining pressure inside the container above ambient pressure.

DETAILED DESCRIPTION OF THE DRAWINGS

Figure 1:
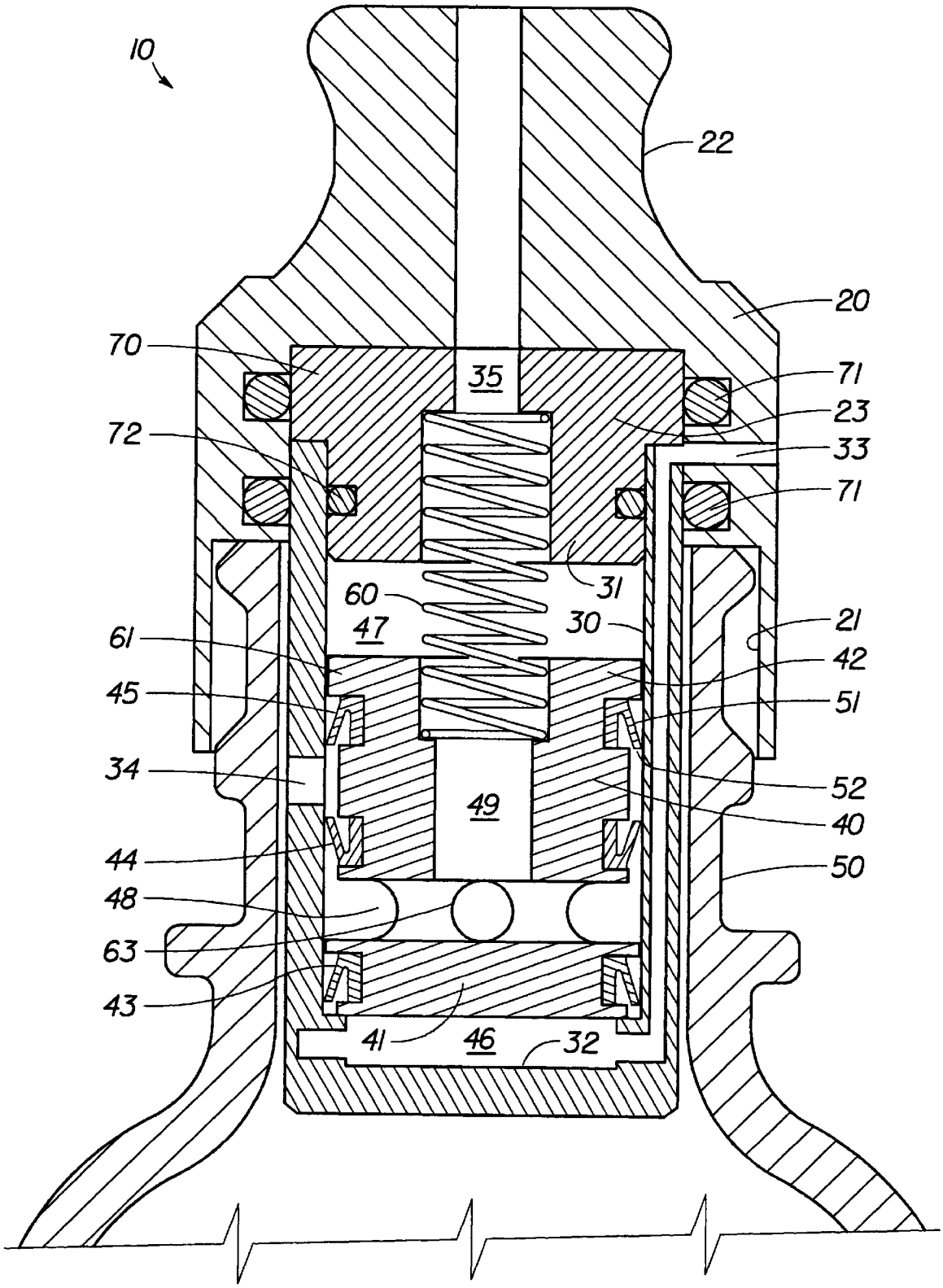
FIG. 1 is a cross section of the closure apparatus mounted to a bottle of liquid beverage with the piston valve biased to the closed position.

The closure apparatus 10 is illustrated generally in FIG. 1 mounted to a container neck 50. The closure comprises a cap valve body 20 an inner cylinder 30 and a piston 40. Cap valve body 20 includes a means for attachment of the closure to the container 21, said attachment means structure depends upon the container neck design to which the closure will be attached. For example if the container neck is threaded, then the closure will be threaded. There are numerous means of attaching closures to containers known to those skilled in the art any of which could be utilized for the present invention. The cap valve body also includes a mouth piece 22 conformed to provide a comfortable mount piece for inserting into the mouth of a user, and an internal valve receiving area 23 providing an area for disposition of the inner cylinder 30.

Although the drawings and description detail a closure cap piston valve which illustrate the valve piston substantially vertical, the valve arrangement may also be horizontal, and positioned on a wide mouth container, such as removable lid, while the mouth piece may also be elongated forming a straw or tubing connection. Likewise the valve may be placed in tubing and used as other fluid flow control means in addition to controlling fluid flow from a beverage container.

Inner cylinder 30 includes a normal straight sided cylinder portion with one end capped and one end open forming a cup type cylinder, the open end is a dispensing end 31 and the capped end is an ambient end 32, the dispensing end is dimensioned to be tightly received in the cap valve receiving area 23 while the ambient end is vented to ambient air through ambient air passageway 33. The cylinder also has a fluid delivery port 34 providing a passageway from the container's interior to the cylinder which is an aperture through the cylinder wall located about half way between each end of the cylinder, the cylinder also has a dispensing port 35 located near the cap valve receiving area 23. The dispensing port 35 provides a passageway from the cylinder through the cap mouth piece 22 and is preferable centrally located on the mouth piece. The cylinder may be provided with a dispensing end cap 70, which is fitted on the open cylinder end before the cylinder is pressed into the cap valve receiving area 23. Seals 71 are preferable located around the cap valve receiving area 23 to provide a sealing area where the cylinder and the cap valve receiving area mate. Additionally, seal 72 provides positive sealing between the dispensing end cap 70 and the cylinder. The cylinder and the cap valve body are most preferable molded of suitable durable plastic as known to those skilled in the art.

Figure 2:
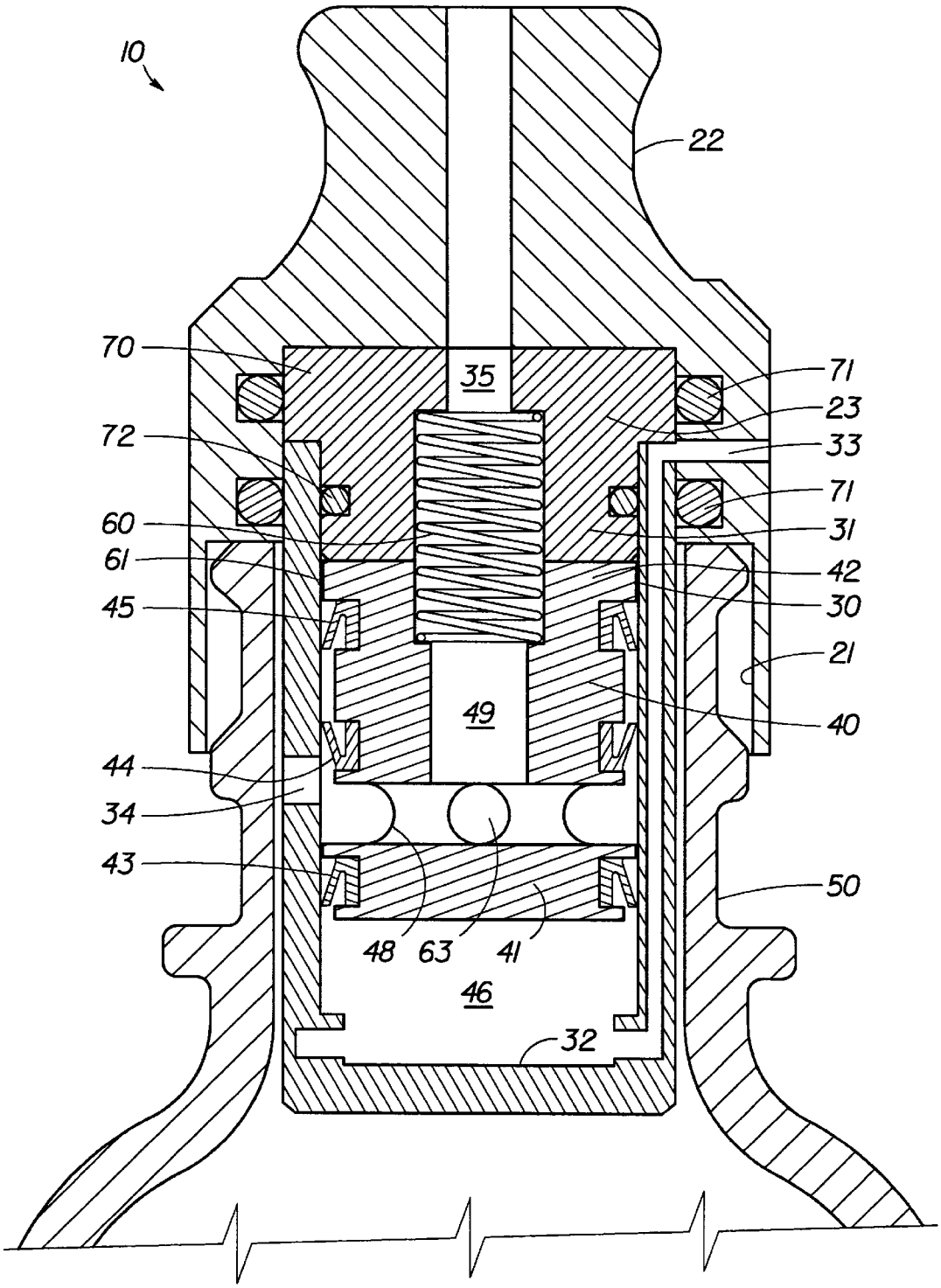
FIG. 2 is a cross section of the closure apparatus mounted to a bottle of liquid beverage with the piston valve in the open position.
Figure 3:
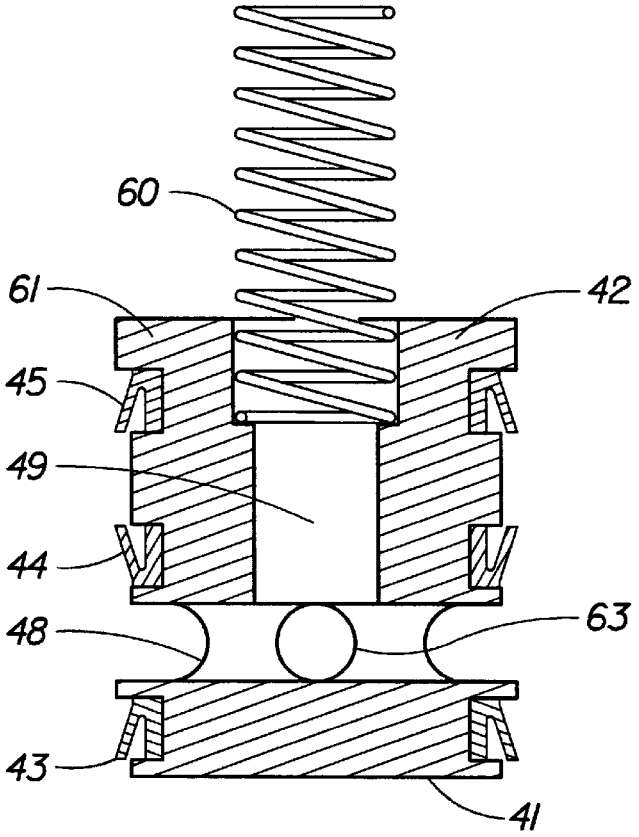
FIG. 3 is an isolated cross sectional view of the piston and the piston spring.
Figure 4:
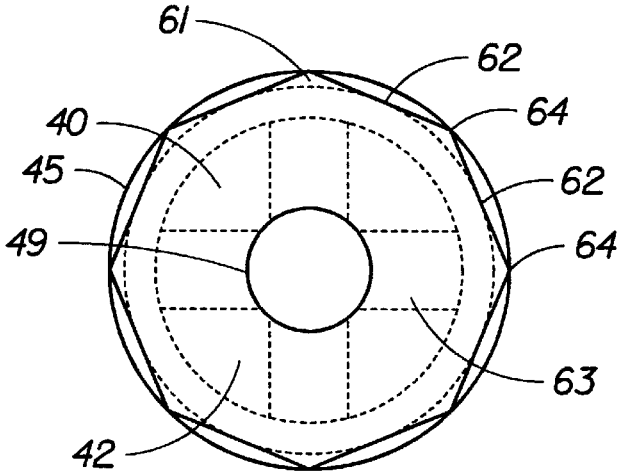
FIG. 4 is an end view of the piston illustrating the geometric shaped piston portion air flow channels.
Figure 5:
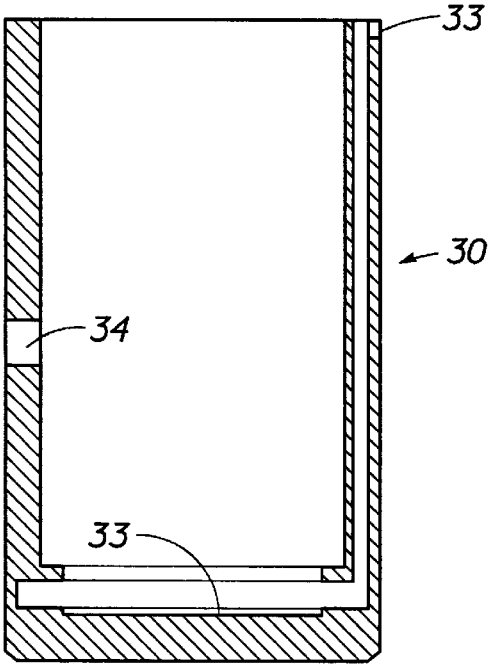
FIG. 5 is a cross section of the valve cylinder illustrating the ambient air passage and the fluid delivery port.
Figure 6:
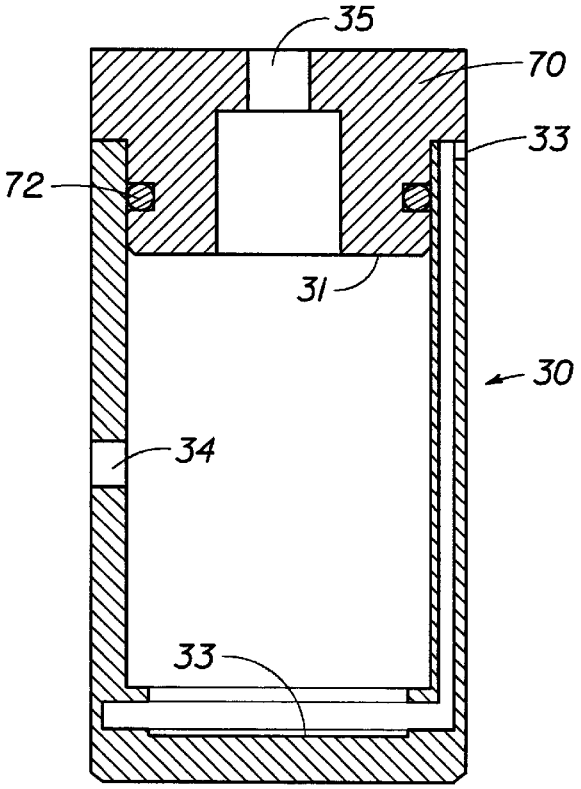
FIG. 6 is a cross section of the valve cylinder and cylinder cap.

Piston 40 has an ambient end 41 position at the ambient end of the cylinder 32 and a dispensing end 42 positioned toward the dispensing end 31 of the cylinder. Three seals are positioned on the piston 40, and include an ambient seal 43, a middle seal 44 and a dispensing seal 45. The seals are most preferable one-way lip seals, as illustrated in the figures, which provide added sealing force as pressure increases on a back side 52 of the lip, and no sealing force when pressure is exerted on front side of the seal 51. Ambient space 46 is formed between the piston and the ambient end of the cylinder, as illustrated in FIG. 1, and dispensing space 47 is formed between the piston and the dispensing end of the cylinder. The piston has a circumferencially positioned fluid delivery groove 48 around its perimeter and positioned between the middle 44 and ambient seals 43. The piston 40 has a centrally located fluid delivery passage way 49 which travels from the top end of the piston 42 to the delivery groove 48, providing a passage way for fluid flow from the delivery groove 48 to the dispensing space 47 and the dispensing port 35. The piston 40 dimensions, the positioning of the three piston seals, and the fluid delivery port 34 are dimensioned and positioned so that when the piston is displaced to the ambient end of the cylinder 32, as in FIG. 1, the fluid delivery port 34 is in communication with the space on the piston between the middle 44 and the dispensing seals 45. Additionally, the middle 44 and dispensing seals 45 are positioned on the piston so that pressure in the container increases, the pressure exerted on the back side of the seals 52 increasing the sealing forces of the lip seals, thus preventing leakage of the container's contents and interior pressure past the seals and from the container interior. Furthermore, the piston dimensions, delivery groove positioning, seal positions on the piston, and delivery port 34 location allow the delivery groove 48 to communicate with the delivery port 34 when the piston is moved toward the dispensing end of the cylinder 31, (as illustrated in FIG. 2) allowing fluid to flow from the container interior through the delivery port 34 to the delivery groove 48 through the piston delivery passage way into the dispensing area 47 and out the dispensing passage way 35. Ambient vent 33 prevents a low pressure from forming in the ambient space 46 when the piston is displaced from the closed to open position, and further prevents increased pressure from forming in the ambient space when the piston moves from the open to the closed position.

The delivery groove 48 allows the piston 40 to be rotated about its center line axis without preventing the delivery port 34 and groove 48 alignment. A multiplicity of delivery ports 34 may be provided to increase the flow of liquid into fluid delivery passage ways.

Figure 7:
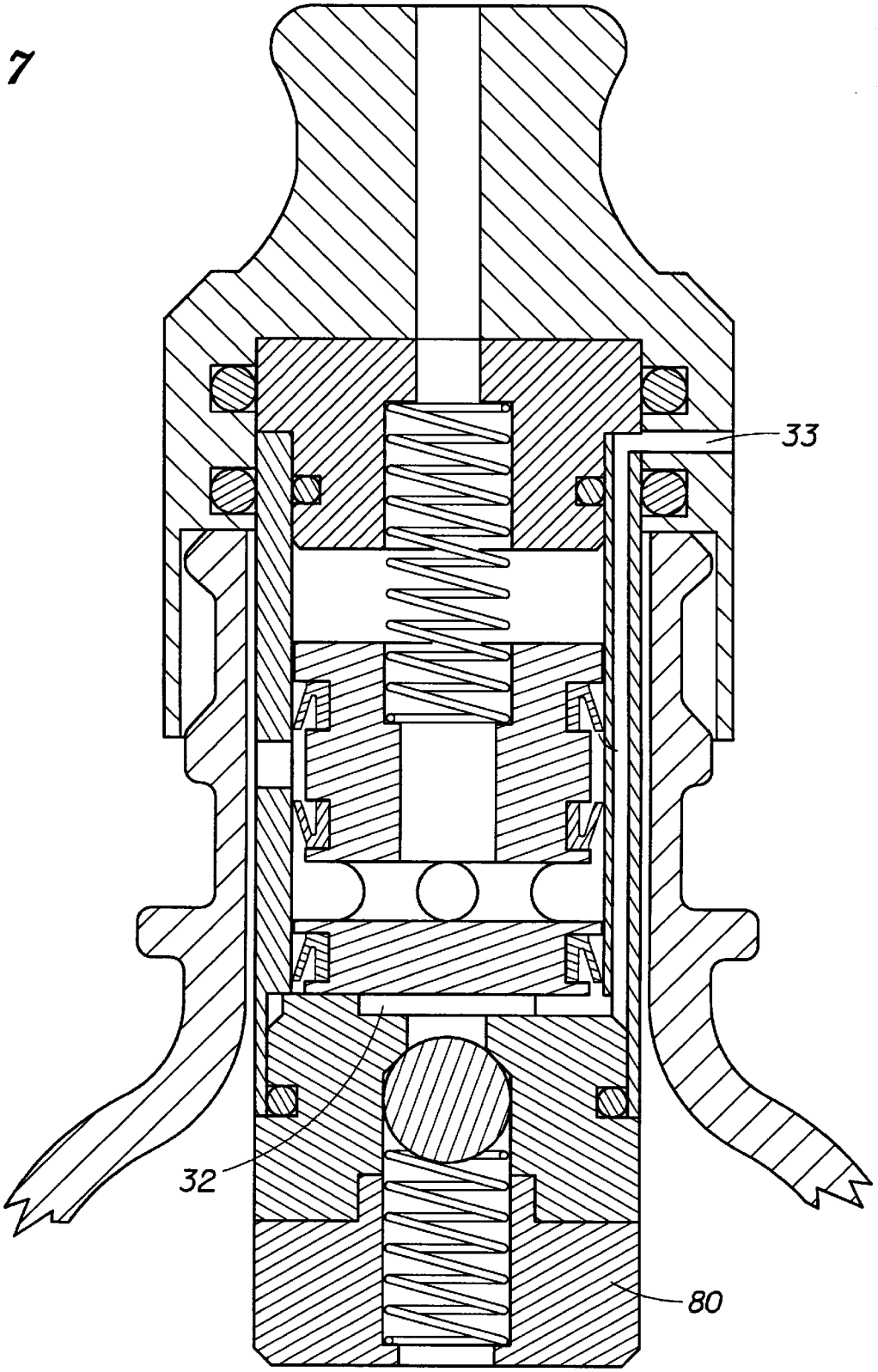
FIG.7 is a cross section of the closure apparatus mounted to a bottle illustrating the pressure equalizing ball valve.

Container interior pressure is maintained above the ambient pressure by the positive sealing forces that the interior pressure exerts on both the top 45 and middle 44 seals. Container interior pressure may fall below the ambient pressure when fluid has been withdrawn from the container's interior through the valve, when this occurs ambient air must be allowed to be vented back into the container interior so that a vacuum does not form in the container's interior. In order to prevent the container vacuum from forming a geometrically shaped piston circumference 61 portion on the piston between the top seal 45 and the piston dispensing end 42 provides a multiplicity of air vent channels 62 extending from the piston dispensing end 42 to the top seal 45 so that as pressure decreases in the container and consequently on the back side 52 of top seal 45 ambient air will travel from the dispensing area through the air vent channels 62 and past the top seal 45 through delivery port 34 and into the container interior thus equalizing the pressure between the container and the ambient. Conversely, when pressure inside the container increases above ambient both the top 45 and middle 44 seals seal, allowing for the pressure inside the container to increase above ambient and thus maintain carbonated beverages. The geometrically shaped piston portion 61 forms projections 64 which conform to the circumference of the remaining parts of the piston thus assisting in proper piston alignment in the cylinder. The container interior pressure equalizing means described above also acts as a dispensing area 47 flushing method, in that when ambient air is flowing into the dispensing passage ways, any residual fluids remaining in these areas are drawn back into the container, preventing unwanted residual fluid from dripping from the valve. An alternative means for equalizing the container interior, but not the preferred means, is illustrated in FIG. 7 where a ball check valve 80 is installed on the ambient end of the cylinder 32 and provides ambient air flow via the ambient air passage 33 into the container's interior, while not allowing pressure to escape from the container interior.

The piston 40 may also preferable include a multiplicity of connecting fluid channels 63 extending from the delivery groove to the fluid delivery passage way 49 to increase fluid flow through the piston 40.

Biasing spring 60 urges piston 40 toward the cylinder ambient end 32 in a closed position as illustrated in FIG. 1 so that the piston is normally closed. The piston 40 is displaced to the open position, toward the dispensing end of the cylinder 31, by either reducing the pressure in the dispensing space 47 of the cylinder or increasing pressure in the ambient space 46 of the cylinder. The pressure differential needed to displace the piston 40 to the open position must be sufficient to overcome the biasing force of the spring 60 and the frictional forces experienced by the piston seals on the cylinder, which is know to those skilled in the art as "breakaway force". Accordingly, the spring used should have a biasing force, along with frictional forces, which can be overcome by the normal pressure reducing force created by a person sucking on the mouth piece of the closure. When the sucking force has been terminated the spring should have enough force to move the piston to the closed position, overcoming the frictional forces of the piston seals against the cylinder. It should be noted, that as the internal pressure of the container increases the sealing forces of the middle and dispensing lip seals increase thereby increasing the frictional forces of the seals against the cylinder wall, and further thereby increasing the breakaway force necessary to displace the piston from the closed to the open positions. The inventor has found that the use of a plastic polymer with low friction qualities decreases the piston displacement forces. Preferable, the use of nylatron or other plastic with lubricant qualities, additives or components should be used to construct the seals or the cylinder.

I claim:

1. A closure apparatus for attachment to a mouth piece of a container, comprising;

a) a cap valve body, comprising a connecting portion providing a means for connecting the apparatus to the mouth piece of the container, an inner cylinder having one end vented to ambient air and the other end open to a dispensing end, said cylinder further having a central fluid delivery port positioned between the ambient and dispensing ends of the cylinder, said delivery port providing a passageway from an interior of the container to the cylinder, b) a moveable piston disposed within said cylinder and a means biasing piston displacement toward the ambient end of the cylinder, said piston further having a bottom end positioned near the ambient end of the cylinder and a top end positioned near the dispensing end of the cylinder, the piston further having a circumferencially positioned fluid delivery groove area positioned between the bottom and top ends and a fluid delivery passageway traveling between the delivery groove and the top end of the piston, c) three ring seals positioned on the piston, comprising; one bottom seal positioned near the bottom end of the piston, one top seal positioned near the top end of the piston, and a middle seal positioned between the top and bottom seals, the seals are further positioned on the piston so that when the piston is biased fully toward the ambient end of the cylinder the cylinder delivery port is positioned between the top and middle seals providing no communication between the interior of the container and the dispensing end of the cylinder and when the piston is displaced toward the dispensing end of the cylinder the delivery port is positioned between the middle and bottom seals providing communication between the interior of the container and the dispensing end of the cylinder through the fluid delivery groove, and d) a means for allowing air to travel from an outside of the container to the interior of the container when air pressure outside the container exceeds pressure inside the container.

2. The closure apparatus as set forth in claim 1 wherein said means biasing the piston toward the ambient end of the cylinder further comprises a spring positioned between the top end of the piston and the dispensing end of the cylinder.

3. The closure apparatus as set forth in claim 1 wherein cylinder ambient vent end provides a means for preventing a vacuum from forming in the area between the piston bottom and the cylinder ambient end when the piston is displaced toward the cylinder dispensing end.

4. The closure apparatus as set forth in claim 1 wherein said top and middle piston seals further comprise a means for providing an increased sealing force between a container exterior and interior as a container interior pressure increases.

5. The closure apparatus as set forth in claim 1 wherein said piston is displaced from the ambient end of the cylinder to the dispensing end of the cylinder by either lowering air pressure on the dispensing end of the cylinder below ambient pressure to a level which overcomes the piston displacement biasing force or by increasing air pressure on the ambient end of the cylinder to a level which overcomes the piston displacement biasing force.

6. The closure apparatus as set forth in claim 5 wherein said air pressure lowering and air pressure increasing is provided by a person sucking on the dispensing end of the cylinder.

7. The apparatus as set forth in claim 1 wherein said piston displacement biasing means is a spring disposed in the space between the piston top and the cylinder dispensing end, said spring having a biasing force which is overcome by a pressure exerted by a person sucking on the dispensing end of the cylinder.

8. The apparatus as set forth in claim 1 wherein said seals comprise lip seals positioned on the piston so as to provide increased sealing forces when pressure increases in the interior of the container.

9. The apparatus as set forth in claim 1 wherein said means for allowing air to travel from an outside of the container to the interior of the container when air pressure outside the container exceeds pressure inside the container, further comprises; a geometrically shaped piston portion located between the piston top seal and the piston top forming air passage ways from the piston top and the cylinder dispensing area to the top seal, further said top seal comprising a oneway lip seal positioned on the piston so that the lip seals when a pressure exceeding ambient pressure exist in the container interior and the seal does not seal when a pressure below ambient pressure exist in the container interior allowing air to travel from outside the container to the space between the top and middle seals and into the container though the cylinder delivery port.

10. The apparatus as set forth in claim 1 wherein said means for allowing air to travel from an outside of the container to the interior of the container when air pressure outside the container exceeds pressure inside the container, further comprises; a one way check valve allowing air to flow into the container but not allowing air to travel out of the container.

* * * * *